US008319697B2

(12) United States Patent
Conrad

(10) Patent No.: US 8,319,697 B2
(45) Date of Patent: Nov. 27, 2012

(54) SEMI-PERMANENT PORTABLE SATELLITE ANTENNA SYSTEM

(75) Inventor: Timothy John Conrad, Mount Pleasant, IA (US)

(73) Assignee: Winegard Company, Burlington, IA (US)

( * ) Notice: Subject to any disclaimer, the term of this patent is extended or adjusted under 35 U.S.C. 154(b) by 624 days.

(21) Appl. No.: 12/603,843

(22) Filed: Oct. 22, 2009

(65) Prior Publication Data

US 2011/0095956 A1 Apr. 28, 2011

(51) Int. Cl.
*H01Q 1/08* (2006.01)
*H01Q 1/12* (2006.01)
*H01Q 19/12* (2006.01)

(52) U.S. Cl. ..... 343/881; 343/878; 343/880; 343/840

(58) Field of Classification Search ..... 343/878, 343/880, 881, 882, 840
See application file for complete search history.

(56) References Cited

U.S. PATENT DOCUMENTS

| | | | | |
|---|---|---|---|---|
| 4,649,675 | A * | 3/1987 | Moldovan et al. | 52/27 |
| 4,799,642 | A * | 1/1989 | Wright | 248/516 |
| 4,922,264 | A * | 5/1990 | Fitzgerald et al. | 343/878 |
| 5,363,116 | A * | 11/1994 | Allen | 343/881 |
| 5,646,638 | A | 7/1997 | Winegard et al. | |
| 5,660,366 | A | 8/1997 | Palmer | |
| 5,760,751 | A | 6/1998 | Gipson | |
| 6,682,029 | B1 | 1/2004 | Dierkes | |
| 6,734,830 | B1 | 5/2004 | Bickham | |
| 6,798,387 | B2 * | 9/2004 | Cockell et al. | 343/878 |
| 7,218,289 | B2 | 5/2007 | Trajkovic et al. | |
| 7,369,097 | B1 | 5/2008 | Sherwood | |
| 7,397,435 | B2 | 7/2008 | McEwan | |
| 2003/0076273 | A1 * | 4/2003 | Cockell et al. | 343/878 |
| 2003/0107525 | A1 * | 6/2003 | Ehrenberg et al. | 343/881 |
| 2007/0279308 | A1 | 12/2007 | Olsen et al. | |

FOREIGN PATENT DOCUMENTS

GB 2167240 A * 5/1986

OTHER PUBLICATIONS

Skywalker Signature Series Non-Penetrating Roof Mount Base (SKY32816) with Interchangeable Mast Pipe (SKY32817A-SKY32817D) User Manual, Retrieved from http://www.skywalker.com/Products/Skywalker-Signature-Series-Non-Penetrating-Roof-Mount-Base-(mast-not-included)_SKY32816.aspx.*

Skywalker Signature Series Non-Penetrating Roof Mount Base (mast not included), [online]. Skywalker Communications, 2009 [retrieved on Dec. 14, 2009]. Retrieved from the Internet: <URL: http://www.skywalker.com/itemdisplay.aspx?item=226172>.

* cited by examiner

*Primary Examiner* — Douglas W Owens
*Assistant Examiner* — Jennifer F Hu
(74) *Attorney, Agent, or Firm* — Dorr, Carson & Birney PC

(57) ABSTRACT

A semi-permanent portable satellite antenna system having a portable mount for deploying a portable satellite antenna. The portable satellite antenna assembles for deployment using releasable connectors. The portable mount can be mounted to a post, a tripod, or a non-penetrating mount. The non-penetrating mount uses a pivoting pair of support wings that pivots upwardly for transportation and downwardly when deployed on a surface. When deployed, ballast is placed on the support wings to stabilize the semi-permanent portable satellite antenna system.

16 Claims, 8 Drawing Sheets

10
20
30
40
50
54
56
60a
60b
70
80
90
95
98
99
100
110a
110b
112a
112b
114a
114b
130
140a
140b
160a
160b
400
530

Fig. 9
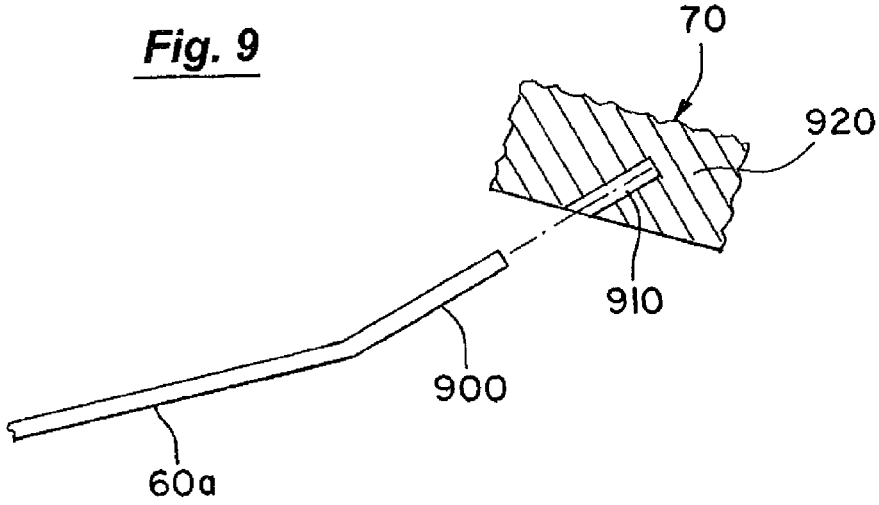
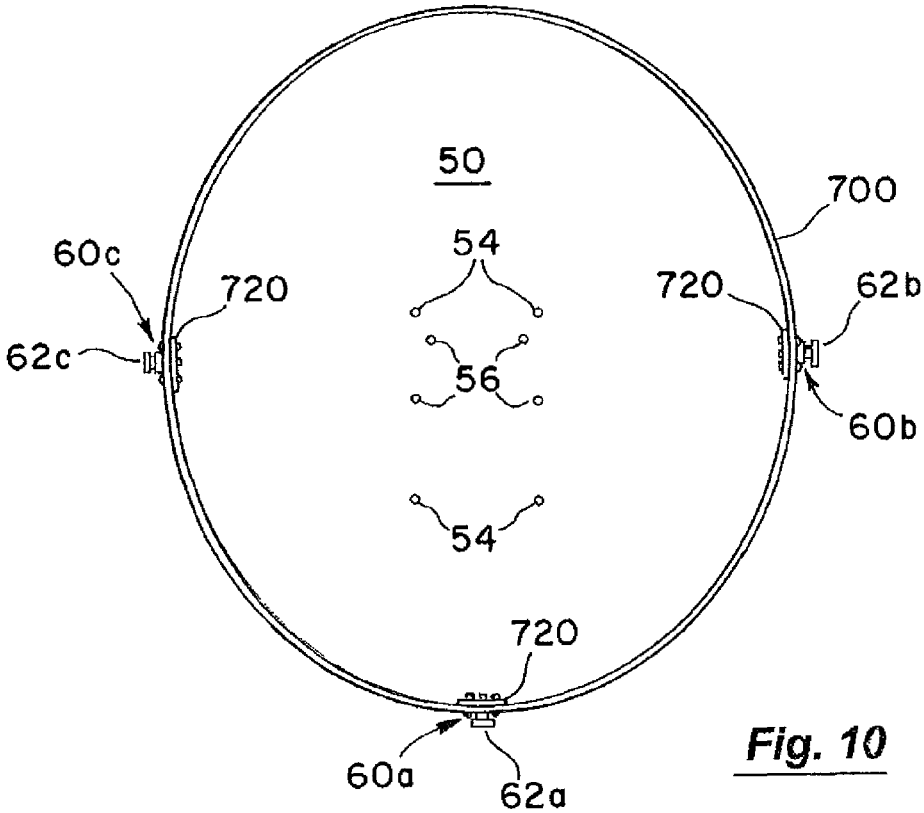
Fig. 10

SEMI-PERMANENT PORTABLE SATELLITE ANTENNA SYSTEM

BACKGROUND OF THE INVENTION

1. Field of the Invention

The invention relates to portable antenna systems and, more particularly, the invention relates to a portable satellite antenna system for semi-permanent use at a variety of rugged and remote locations.

2. Discussion of the Background

Customers, especially business customers, continually require a lower cost portable automatic satellite acquisition antenna system especially for two-way internet applications at remote locations.

In the past a number of portable collapsible satellite antenna systems have been patented. For example, U.S. Pat. Nos. 7,369,097 and 5,660,366 teach portable dish antennas supported by collapsible tripods. U.S. Publication No. 2007/0279308 discloses the use of suction cups to remove a satellite antenna from one surface to another. U.S. Pat. No. 5,646,638 provides a portable collapsible satellite dish antenna system for hand carrying from one location to another. And, U.S. Pat. No. 6,734,830 shows a portable adjustable stand for a satellite dish antenna using a stand having a pair of parallel spaced, laterally adjustable longitudinal brackets. Satellite antenna systems can be disassembled and/or folded for transportation in cases. U.S. Pat. No. 7,397,435 shows a quick release stowage system for transporting a mobile satellite antenna. U.S. Pat. No. 7,218,289 also shows a portable microwave reflector antenna that can be stowed in two hard shell airline cases.

Some prior approaches use ballast to stabilize the deployed portable collapsible satellite antenna system especially when the deployed system is used for a period of time. U.S. Pat. Nos. 6,682,029 and 5,760,751 shows a collapsible satellite dish antenna mount having a hollow base container for holding ballast. U.S. Pat. No. 6,798,387 sets forth a non-penetrating roof mount for a transportable satellite antenna using ballast such as cement blocks.

A need further exists for an easily disassembled satellite antenna that is compactly transported, but easily assembled for use not only on a portable mount such as collapsible non-penetrating mount, but also mounted on a lightweight portable tripod or even mounted on a pole. The satellite antenna system has a further need to have automatic azimuth, automatic elevation and automatic skew mechanisms.

A final need exists for such a semi-permanent satellite system that will be available with cases to transport the system such as military style plastic, panel type fabricated cases or even wooden crates.

SUMMARY OF THE INVENTION

A semi-permanent portable satellite antenna system having a portable satellite antenna and a portable mount such as a non-penetrating mount, a tripod, or a pole for holding the portable satellite antenna on a surface when the semi-permanent portable satellite antenna system is deployed. The portable satellite antenna assembles for deployment on the portable mount and disassembles for portability. The non-penetrating mount also collapses for portability.

The portable satellite antenna has an antenna mount with a reflector plate and a mount cap. The mount cap releasably connects to the portable mount when the semi-permanent portable satellite antenna system is deployed on the surface. The portable satellite antenna also has a reflector releasably connected to a reflector plate on the antenna mount. The reflector has a rear surface and an outer rim. A number of threaded knobs releasably connect the rear of the reflector to the reflector plate on the antenna mount. The antenna mount controls azimuth and elevation of said reflector. The portable satellite antenna also has three feed arms. A knob retained on each end of the feed arms releasably connects to the outer rim of the reflector. A feed having a skew mechanism releasably connects to the other ends of the three feed arms. When the portable satellite antenna is assembled for deployment on the surface, the antenna mount is first mounted to the portable mount. Then, knobs are used to assemble the reflector to the reflector plate in the antenna mount. The three feeds arms arm are then mounted to the rim of the reflector with the retained knobs. The feed is finally assembled to the remaining ends of the three feed arms. The process is reversed to disassemble the portable satellite antenna for transportation.

The portable satellite antenna can be mounted to a pole, a tripod, or to a portable collapsible non-penetrating mount. The portable collapsible non-penetrating mount has an elongated channel with a post having one end of the post attached perpendicularly at the center of the channel with the other end holding the deployed portable satellite antenna. A pair of angled support braces has one end attached to the post and the other end attached to the channel to rigidly support the post with respect to the channel. A pair of folding support wings is pivotally connected on either side of the elongated channel. The pair of support wings pivots upwardly towards the post for transportation and pivots down to the surface when deployed. A pair of angled locking arms having one end releasably connected to the post and the other end releasably connected to a support wing to rigidly support the post with respect to the support wings and to orient the support wings to lay flat on the surface. The pair of locking arms easily release from the post and the support wings for portability. When deployed, ballast such as cement blocks are placed in the support wings to stabilize the satellite antenna mount to the surface.

The summary set forth above does not limit the teachings of the invention especially as to variations and other embodiments of the invention as more fully set out in the following description taken in connection with the accompanying drawings.

BRIEF DESCRIPTION OF THE DRAWINGS

FIG. 9 is a detail side cut-away view of the lower feed arm connecting to the feed of the feed attaching to the feed arms.

FIG. 10 is a planar view of the rear of the reflector.

DETAILED DESCRIPTION OF THE INVENTION

Figure 1:
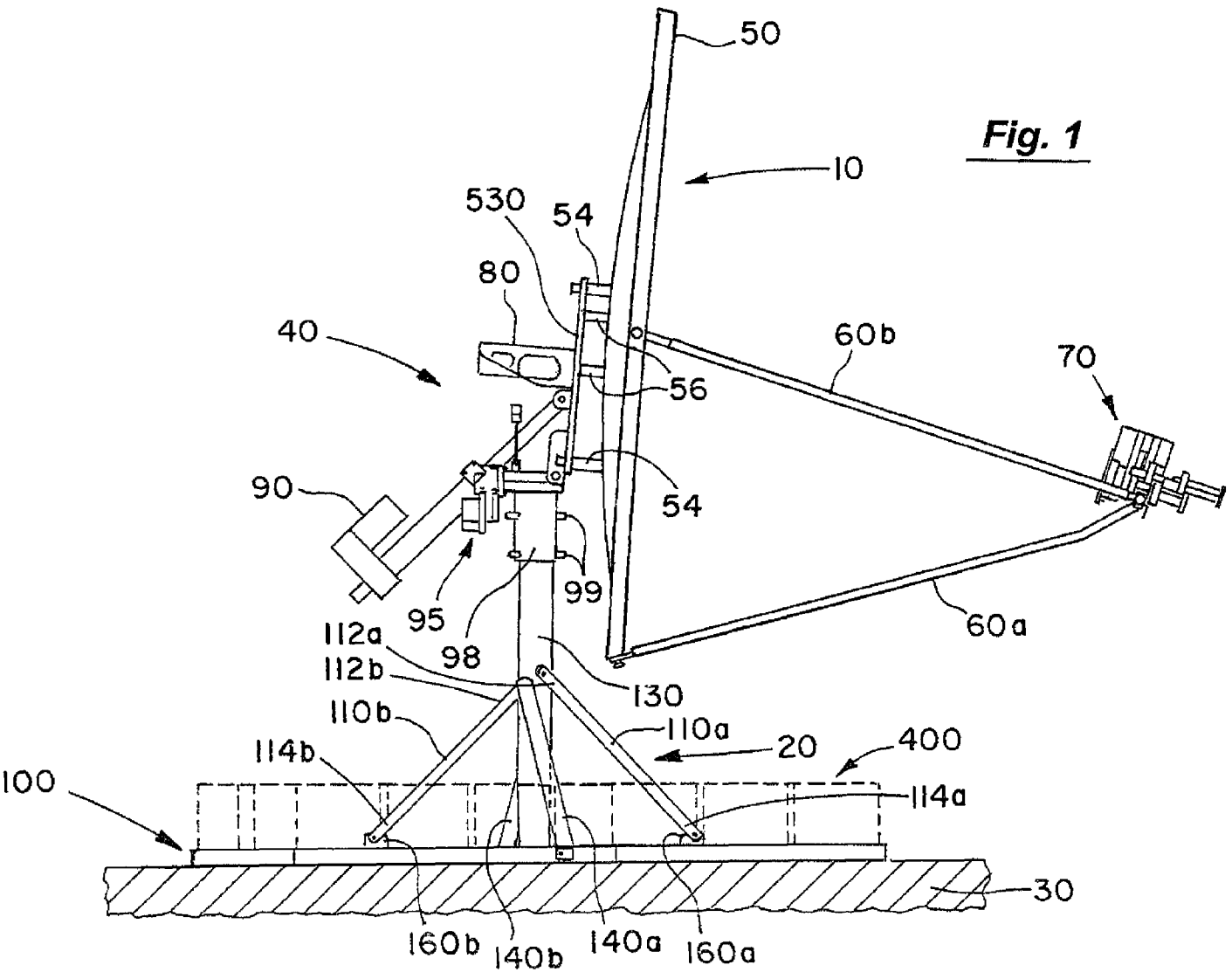
FIG. 1 is a side view of the semi-permanent portable satellite antenna system of the invention having a portable satellite antenna and a portable non-penetrating mount.

In FIG. 1, the assembled portable satellite antenna 10 of the invention is shown held by the portable collapsible non-penetrating mount 20 of the invention on a surface 30 such as ground. This shows the semi-permanent portable satellite antenna system of the invention deployed for semi-permanent use on a surface. Any surface 30 could be used such as a platform, concrete pad, roof, wood decking, etc. The portable satellite antenna 10 of the invention has an antenna mount 40 and a reflector 50 having feed arms 60*a*, 60*b*, and 60*c* (generally referred to as feed arms 60) and a feed 70. The feed 70 preferably also has a mechanism for skew adjustment. Also shown are the electronics control box 80, the elevation actuator 90, and the azimuth motor 95. The reflector 50, depending on the application, may be a 1.2 or 0.96 meter dish, but any sized reflector 50 can be used. The antenna mount 40 can also be held by a post into the surface such as a ground surface 30, held by a tripod on the surface 30, etc. For purposes of this invention, the term "portable mount" is defined to be a post, a tripod, or a non-penetrating mount such as the non-penetration mount of the invention disclosed herein.

Figure 2:
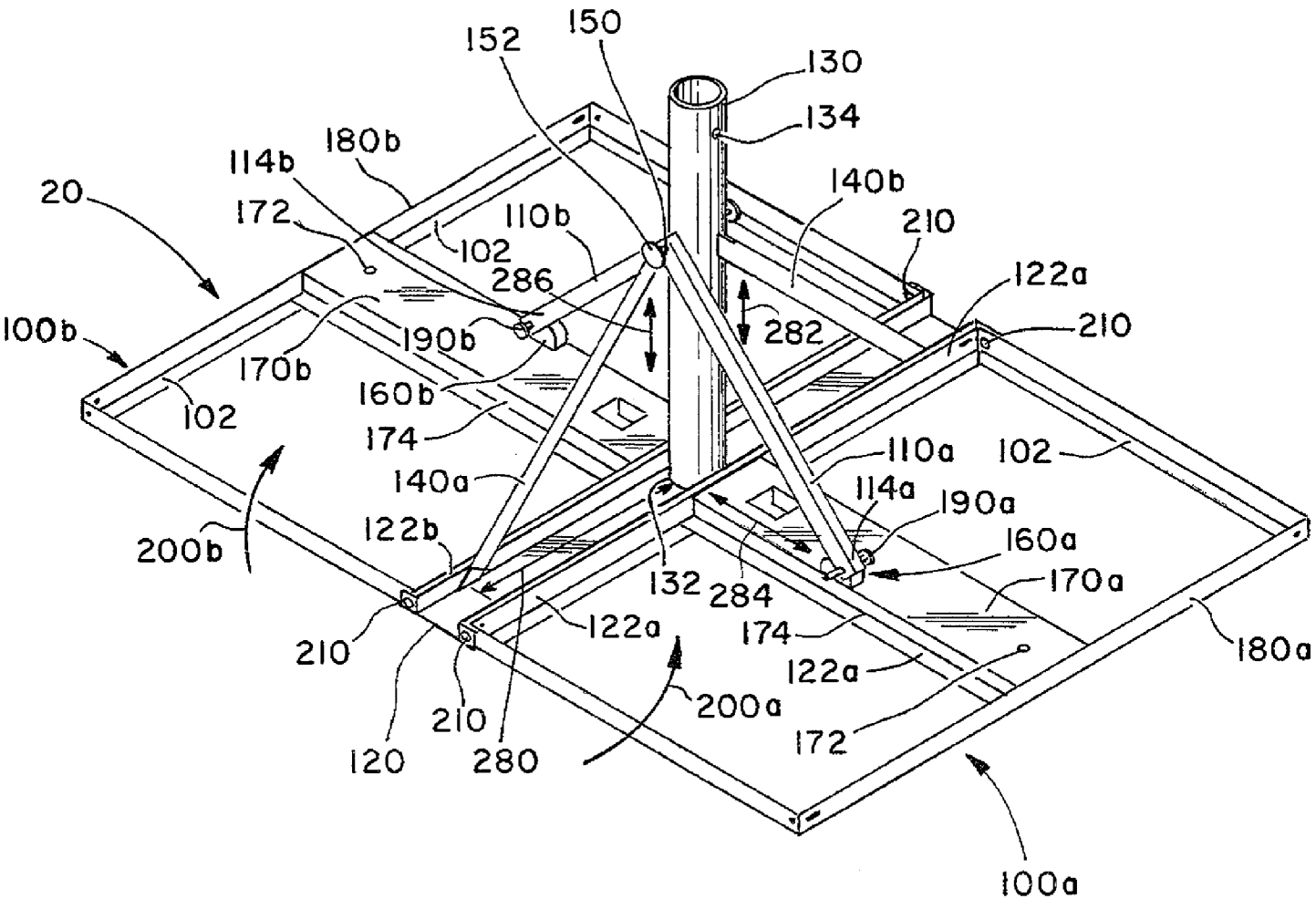
FIG. 2 is a perspective view of the portable non-penetrating mount deployed.

Details of the collapsible non-penetrating mount 20 of the invention are shown in FIGS. 1 and 2 to include a pair of opposing support wings 100*a* and 100*b*, a pair of releasable locking arms 110*a* and 110*b*, an elongated channel 120 to which is attached a post 130 at one end 132. The post 130 in one embodiment is integrally attached by welding the end 132 to the bottom of the channel 120 and the post 130 is oriented perpendicular to and in the center the channel 120. The post 130 can be a metal pipe having any suitable diameter such as 3 inches or any suitable shape such as square or rectangular rather than circular.

Support braces 140*a* and 140*b* provide rigid support to the post 130 from opposing sides 122*a* and 122*b* of the channel 120. Support braces 140*a* and 140*b* are attached to the elongated channel 120 and to opposing sides of the support post 130 such as by welding, bolts or by any other suitable attachment.

The portable satellite antenna 10 has a cylindrical mount cap 98 which goes over the post 130 and is connected with bolts 99 such as ⅜ inch bolts. In the event, the post 130 is not circular; the cap 98 will have a configuration that matches the post. The mount cap 98 mounts to any suitable portable mount.

The angled locking arms 110*a*, 110*b* and the angled support braces 140*a*, 140*b* form a substantially pyramidal rigid support structure for post 130 which firmly holds the assembled portable satellite antenna 10 in the deployed position as shown. Each support brace 140*a* and 140*b* has one end is attached to the side of the channel 120 a first set distance from the post 130 as shown by arrow 280 and the other end attached to the post 130 a second set distance from the bottom of the channel 120 as shown by arrow 282. Each releasable locking arm 110*a* (and 110*b*) has one end 114*a* (and 114*b*) attached to the support wing 100*a* (and 100*b*) a first distance from the post 130 as shown by arrow 284 and the other end 112*a* (and 112*b*) attached to the post 130 a second distance from the bottom of the channel 120 as shown by arrow 286.

As shown in FIG. 1, one end 112*a*, 112*b* of the locking arms 110*a*, 110*b* is connected with a bolt 150 having a knob 152 to the post 130 so as to be releasable. The opposing ends 114*a*, 114*b* of the locking arms 110*a* and 110*b* are connected to pivots 160*a* and 160*b* on center brackets 170*a* and 170*b* of support wings 100*a* and 100*b* so as to be releasable. The center brackets 170*a* and 170*b* are welded to the outer rectangular frame 180*a* and 180*b* of the support wings 100*a* and 100*b*. Releasable hinge pins 190*a* and 190*b* are used to connect the locking arms 110*a* and 110*b* to the center brackets 160*a* and 160*b*.

Figures 3, 3A:
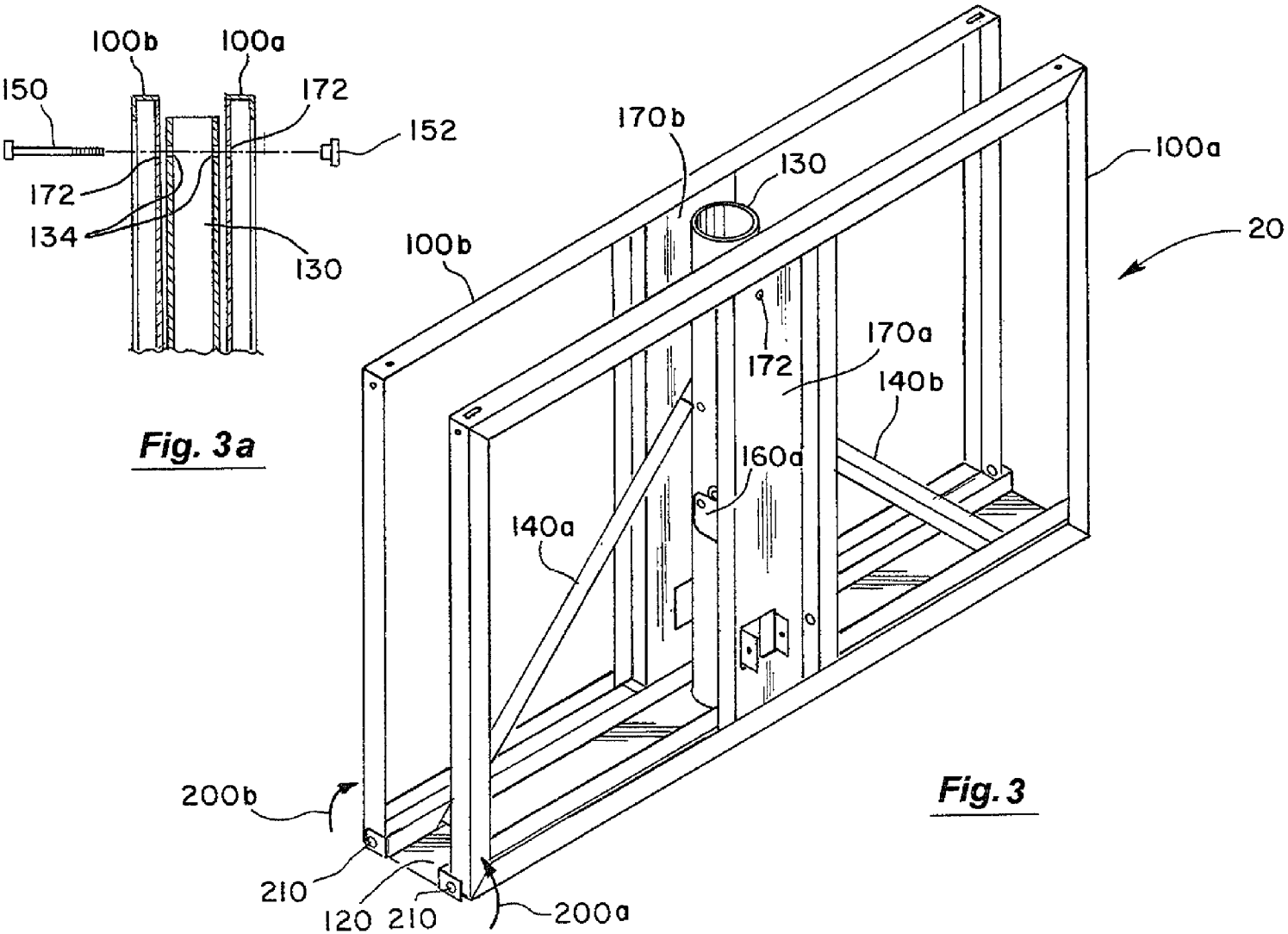
FIG. 3 is the portable non-penetrating mount of FIG. 2 folded for transportation.

The portable non-penetrating mount 20 shown deployed in FIGS. 1 and 2 on surface 30. The non-penetrating mount 20 is shown folded (collapsed) in the directions 200*a* and 200*b* of FIGS. 2 and 3 for portability and for easy transport. The portability configuration shown is achieved by removing hinge pins 190*a* and 190*b* (shown in FIG. 2). In addition, the threaded knob 152 is removed from the bolt 150 to fully release the locking arms 110*a* and 110*b* from opposing sides of the post 130. The support wings 100*a* and 100*b* are then moved in directions of 200*a* and 200*b* upwardly to assume the folded orientation shown in FIG. 3. Each support wing 100*a* and 100*b* is connected at pivot points 210 to the channel 120. The locking arms 110*a* and 110*b* have been fully released and removed from the portable non-penetrating mount 20 and are put inside of the post 130 for stowing along with the hinge pins 190*a* and 190*b*. The knob 152 and bolt 150 are then used to pass through formed holes 172 of the support brackets 170*a* and 170*b* through a corresponding formed hole 134 in the post 130 and above the locking arms 110*a* and 110*b* stored within the post 130. The bolt 150 and the knob 152 firmly hold the two opposing support wings 100*a* and 100*b* firmly against opposing sides of the post 130 for portable transport as shown in FIG. 3*a*. The bolt 150 passing through the center of the post 130 holds the two locking arms in the post 130 for stowing.

Figure 4:
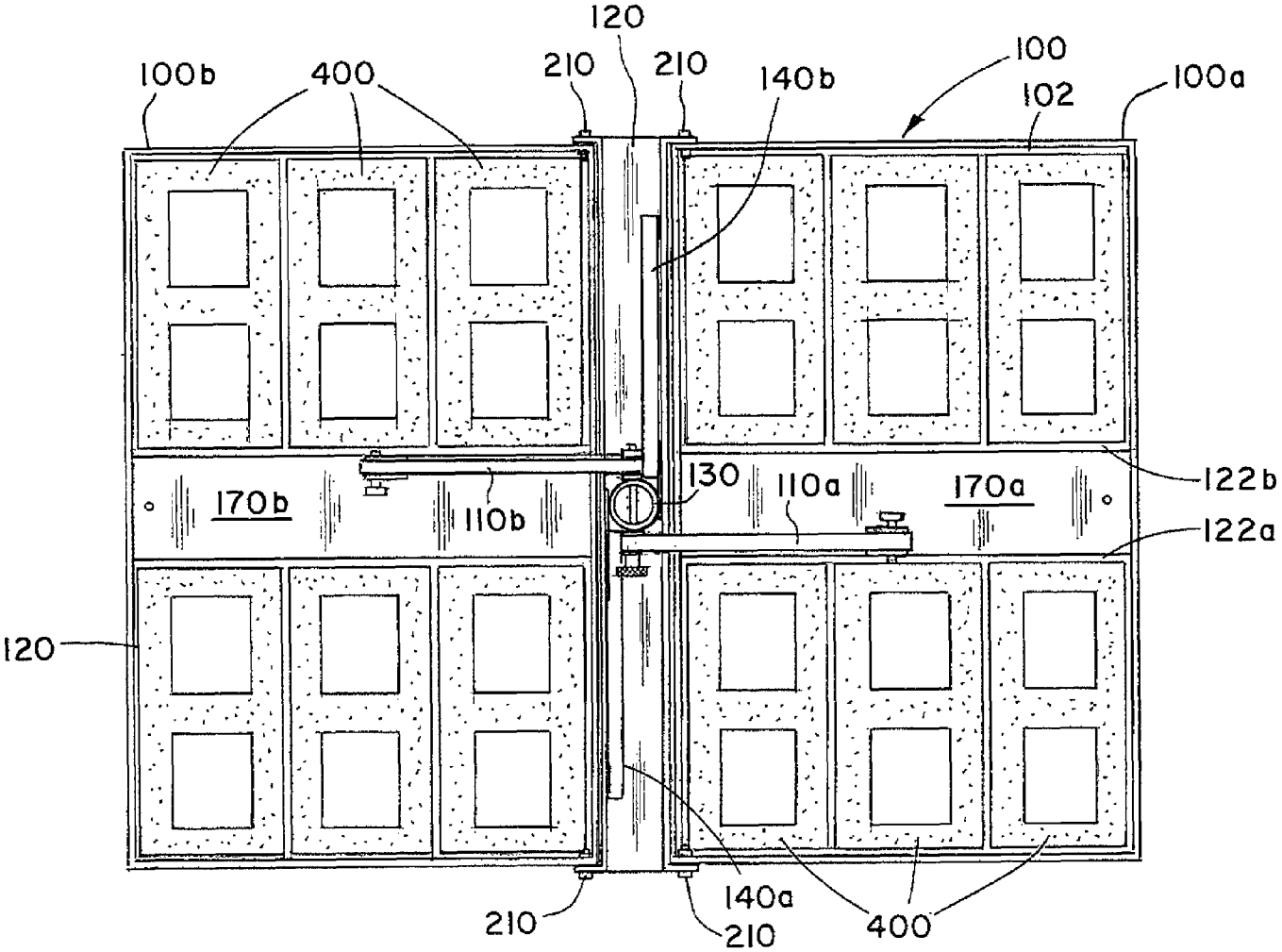
FIG. 4 is a top view of the deployed portable non-penetrating mount of FIG. 2.

FIGS. 1 and 4 show ballast 400 comprised, for example, of twelve cement cinder blocks placed in the support wings 100*a* and 100*b* to provide sufficient weight to firmly hold the portable non-penetrating mount 20 to the ground 30. The blocks 400 rest on edges 102 of support wings 100*a* and 100*b*, edges 122*a*, 122*b* of channel 120 and edges 174 of center brackets 170 as best shown in FIG. 2. The weight of the twelve cinder blocks is approximately 500-600 pounds. Any suitable ballast 400 can be provided such as sand bags, logs, or even large rocks. In other embodiments, the bottoms of the opposing support wings 100*a* and 100*b* are solid such as a plate of metal and sand or dirt can be placed on the plates as ballast 400.

The portable collapsible non-permanent mount 20 of the invention shown in FIGS. 1-4 has a folded state (FIG. 3) for easy transport and a deployed state (FIG. 2) for use in holding the satellite antenna 20. During transport the locking arms 110 and hinge pins 190 are stowed inside the post 130 so that all components are transported together.

In summary, the semi-permanent collapsible portable mount 20 of the invention uses an elongated channel 120 to support a perpendicular post 130 for holding the portable satellite antenna 10. A pair of support braces 140 have one end attached a first set distance above the elongated channel 120 to the post 130 and the other end attached a second set distance from the post on the elongated channel 120. The pair of support braces 140 opposes each other on the elongated channel 120. A pair of support wings 100 is pivotally connected to the elongated channel 120. The support wings 100 pivot to the post 130 when stowed for portable movement and pivot to onto a surface 30 when deployed. A pair of locking arms 110 have one end releasably connected a first distance above the elongated channel 120 to the post 130 and a second end releasably connected a second distance from the post 130 on one of the pair of support wings 100. The pair of locking arms 110 opposes each other on the pair of support wings 100 when deployed, but the arms 110 release for portability.

Figure 5:
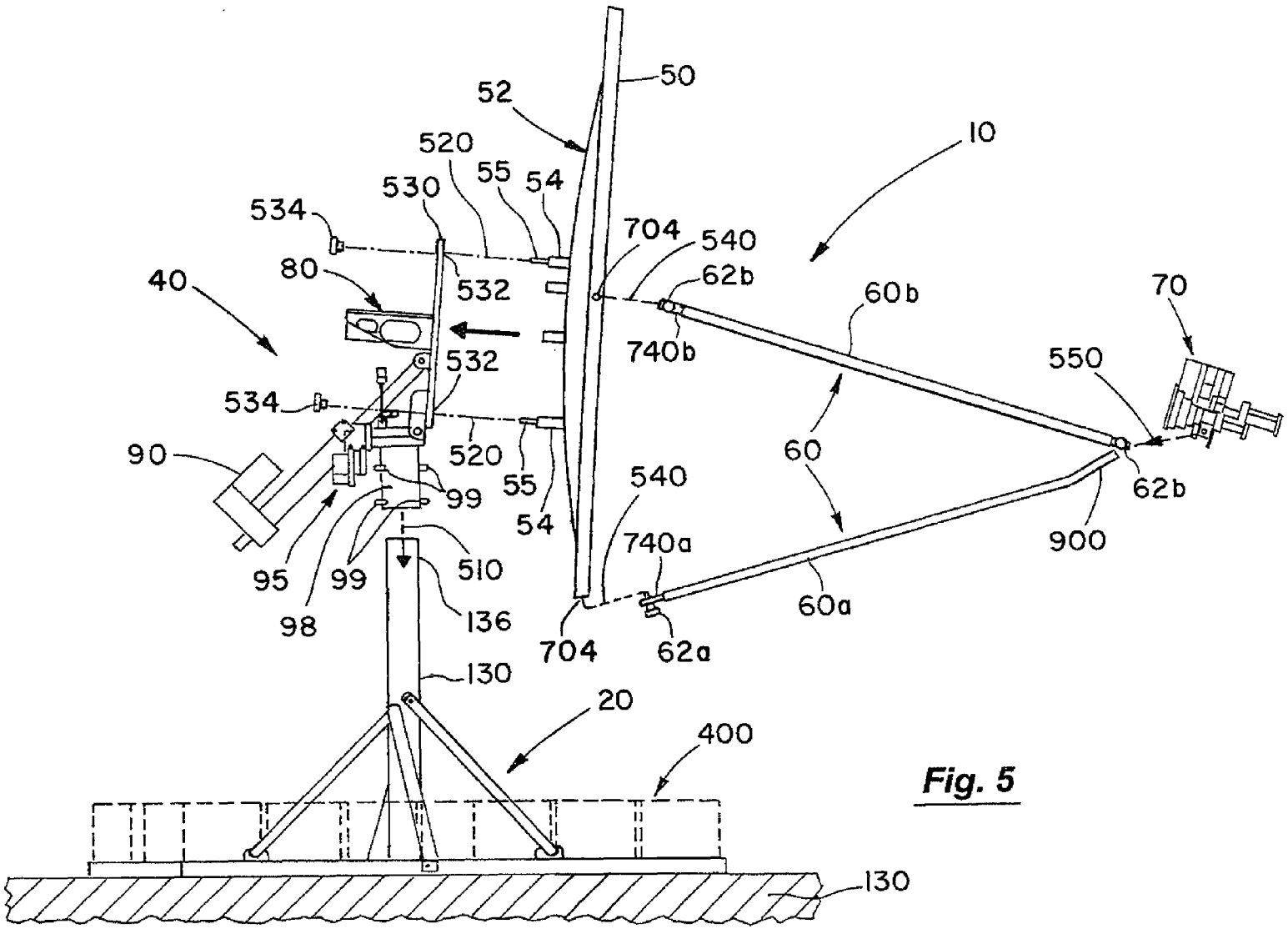
FIG. 5 is an illustration showing the steps of assembly of the portable satellite antenna to the portable non-penetrating mount.

In FIG. 5, the details and the assembly steps for the portable satellite antenna 10 of the invention are set forth. The portable satellite antenna 10 of the invention is shown disassembled and separate from the deployed portable non-penetrating mount 20 on surface 30. The portable satellite antenna 10 can be used on any portable mount.

In the first step, the semi-portable mount 40 having the mount cap 98, the elevation actuator 90, the outdoor electronics box 80, and the azimuth motor 95 is moved as a unit in the direction of arrow 510 so that the mount cap 98 fits over and rests on the upper end 136 of post 130. At this step, the six bolts 99 are tightened with a wrench to retain the cap 98 against the end 136. Any suitable number of bolts can be used. The mount cap 98 can also mount to a post in the ground or onto a tripod on the ground.

Figure 11:
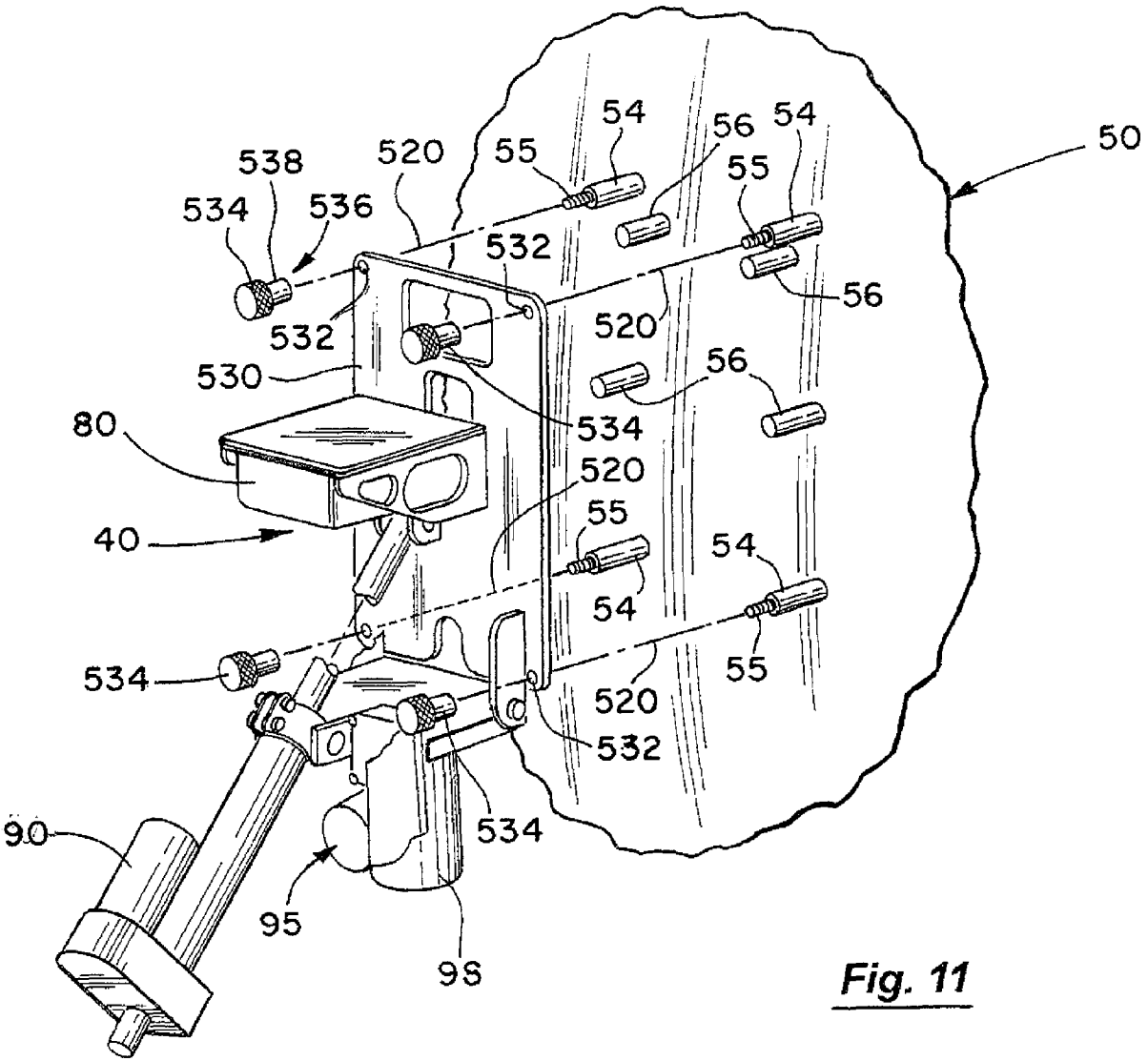
FIG. 11 is a partial exploded view showing the connection of the reflector to the dish plate.

In the second step, the reflector 50 is moved as a unit in the direction of dotted lines 520 toward the dish plate 530 in the antenna mount 40 as shown in FIG. 11. The rear 52 of the reflector 50 has four posts 54 with threaded studs 55. The threaded studs 55 pass through the formed holes 532 in the dish plate 530. Knobs 534 are then used to quickly thread onto the studs 55 to firmly hold the reflector 50 to the dish plate 530 as shown in FIG. 1. Each knob 534 has a formed threaded hole 536 in a collar portion 538. Any suitable number of threaded posts 54 can be used. No tools are required to attach the reflector 50 to plate 530.

Figure 6:
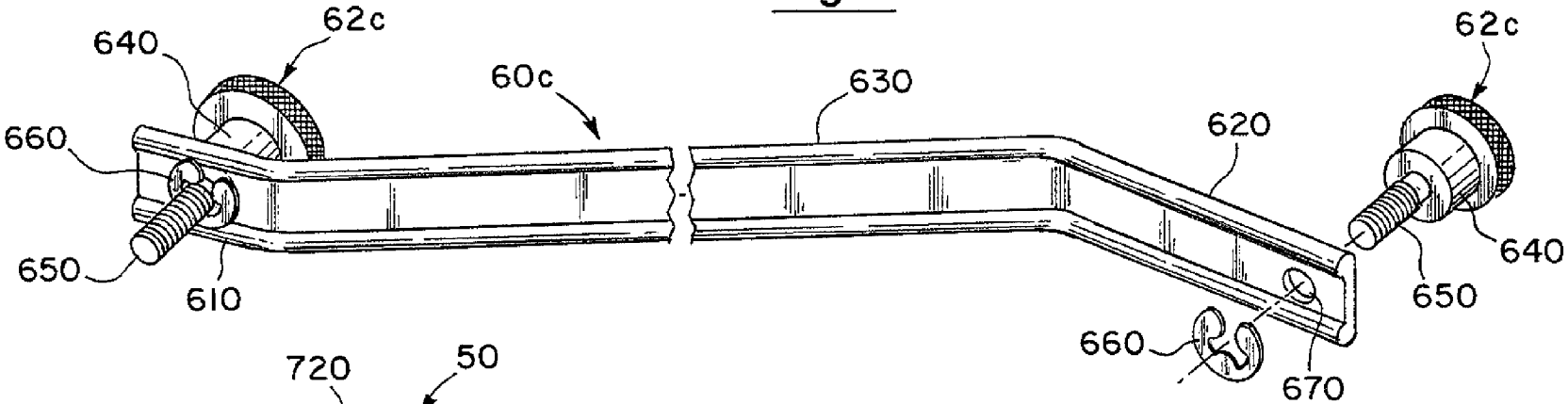
FIG. 6 is a perspective view of a feed arm.
Figure 8:
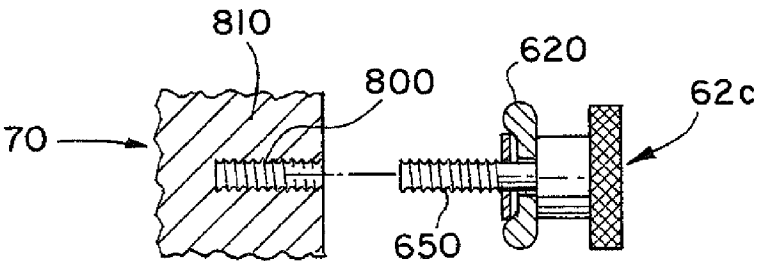
FIG. 8 is a detail side cut-away view of the feed arm mounting to the feed.
Figure 7:
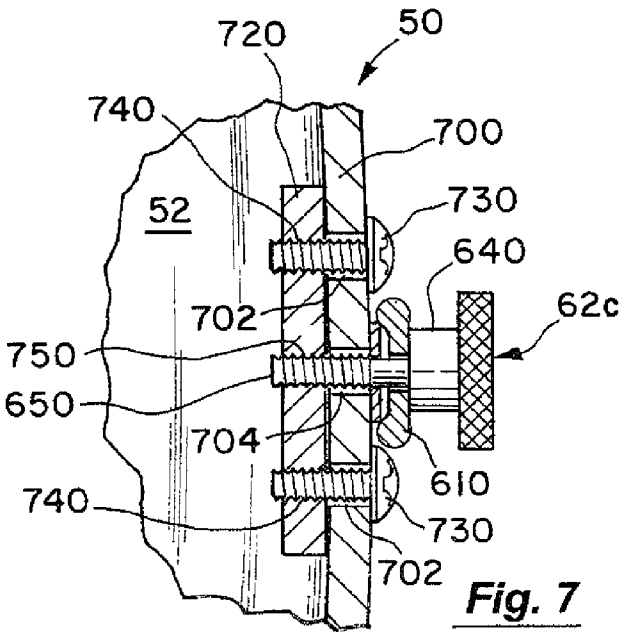
FIG. 7 is a detail side cut-away view of the feed arm connecting to the reflector.

In the third step, the three feed arms 60 (60*a*, 60*b*, and 60*c*) are attached as shown in FIG. 5 to the rim of the reflector 50 using three stainless steel knobs 62*a*, 62*b*, and 62*c* by moving the arms 60 in the direction of arrows 540 to affixation holes 704. In FIG. 6 feed arm 60*c* is shown with angled ends 610 and 620 with a body 630 therebetween. At each end 610, 620 is a knob 62*c*. Each knob 62*c* has a cylindrical standoff portion 640 and a threaded stud portion 650. A retainer clip 660 is used to hold the knob 62*c* to one of the ends 610, 620. As shown in FIG. 7, the reflector 50 has an outer rim 700 that has formed holes 704 (three, one for each feed arm 60*a*, 60*b*, and 60*c*). Behind the rim 700 is a plate 720 that is held by two bolts 730 which engage threaded holes 740 in plate 720. The threaded stud portion 650 of knob 62*c* engages a threaded hole 750 in the plate 720. The structure of FIG. 7 is the same for the engagement of all three knobs 60*a*, 60*b* and 60*c* to the rim 700 of the reflector. The other end 620 of feed arm 60*c* uses knob 62*c* in a similar fashion to engage a threaded hole 800 in the block 810 of the feed horn/skew mechanism 70. Feed arm 60*c* connects in the same structural manner. The end 900 of feed arm 60*a* does not have a knob, but the end 900 slides into a formed slot 910 in the block 810 as shown in FIG. 9. The three ends 740*a*, 740*b*, and 740*c* of arms 60*a*, 60*b*, and 60*c* are easily attached to the rim 710 of the reflector 50 with knobs 62*a*, 62*b*, and 62*c* respectively. The number of feed arms is a matter of design choice. No tools are required to attach the feed arms 60 to the reflector 50.

In the fourth step, the feed 70 is moved in the direction of arrow 550 and attaches to the feed arms 60. In FIG. 5, the feed 70 is attached to the three feed arms 60 with two knobs 62*b* and 62*c* and with end 900 sliding into slot 910. No tools are required. As shown in FIG. 1, the weight of feed 70 causes the feed 70 to firmly connect to end 900.

It is to be understood that a number of different mechanical designs can be utilized to quickly connect to and release from the feed arms 60*a*, 60*b*, and 60*c* to the reflector 50 and to the feed 70.

In FIG. 10, the rear reflector 50 is shown with the three knobs 62*a*, 62*b*, and 62*c* connecting the three feed arms 60*a*, 60*b* and 60*c*. In the center of the reflector are four threaded posts 54 and four standoff posts 56. As shown in FIG. 1, the four standoff posts 56 abut the dish plate 530.

The portable satellite antenna 10 of the invention shown in FIGS. 1 and 5-11 has a disassembled state (FIG. 5) for easy transport and a deployed state (FIG. 1) mounted on a portable mount.

In summary, the portable satellite antenna 10 has an antenna mount 40 with a dish plate 530 and a mount cap 98. The mount cap 98 releasably connects to the portable mount 20 such as the semi-permanent portable satellite antenna system. The rear of the reflector 50 releasably connects to the reflector plate 530 in the antenna mount 40 by using a number of threaded knobs 534. The antenna mount 40 controls azimuth and elevation of the reflector 50 when connected to the reflector plate 530. The portable satellite antenna 10 has three feed arms 60. A knob 62 is retained on each end of the feed arms 60 for releasably connecting to the outer rim of the reflector 50. A feed 70 having a skew mechanism releasably connects to the three feed arms 60.

The above disclosure sets forth a basic embodiment of the invention described in detail with respect to the accompanying drawings with a number of variations discussed.

Certain precise dimension and weight values have been utilized in the specification. However, these dimensions do not limit the scope of the claimed invention and those variations in angles, spacings, dimensions, configurations, and dipole shapes can occur.

It is noted that the terms "preferable" and "preferably," are given their common definitions and are not utilized herein to limit the scope of the claimed disclosure. Rather, these terms are intended to highlight alternative or additional features that may or may not be utilized in a particular embodiment of the present disclosure.

For the purposes of describing and defining the present disclosure it is noted that the term "substantially" is given its common definition and it is utilized herein to represent the inherent degree of uncertainty that may be attributed to any shape or other representation.

Those skilled in this art will appreciate that various changes, modifications, use of other materials, other structural arrangements, and other embodiments could be practiced under the teachings of the invention without departing from the scope of this invention as set forth in the following claims.

I claim:

1. A semi-permanent portable satellite antenna system comprising: a portable mount deploying a portable satellite antenna on a surface, said portable mount comprising:

an elongated channel;

a post, one end of said post attached at the center of said elongated channel, said post oriented perpendicular to said elongated channel, the other end of said post holding said satellite antenna when deployed;

a pair of support braces, one end of each support brace in said pair of support braces attached a first set distance above said elongated channel to said post, the other end of each said support brace attached a second set distance from said post to said elongated channel, said pair of support braces opposing each other on said elongated channel;

a pair of support wings, one side of each support wing in said pair pivotally connected to one side of said elongated channel, said pair of support wings pivotally connected on opposing sides of said elongated channel, said pair of support wings pivoting to said post for portability and said pair of support wings pivoting to be on said surface when deployed;

a pair of locking arms, a first end of each of said pair of locking arms releasably connected a first distance above said elongated channel to said post, a second end of each said locking arm releasably connected a second distance from said post on one of said pair of support wings, said pair of locking arms opposing each other on said pair of support wings when deployed, said pair of locking arms released for portability.

2. The semi-permanent portable satellite antenna system of claim 1 further comprising:

ballast, said ballast resting on said pair of support wings when deployed, said ballast holding said portable mount to said surface.

3. The semi-permanent portable satellite antenna system of claim 1 wherein said ballast comprises:

a plurality of cement blocks.

4. The semi-permanent portable satellite antenna system of claim 1 further comprising:

a pair of connectors releasably connecting said second ends of said pair of locking arms to said pair of support wings when deployed;

a second connector releasably connecting said first ends of each of said pair of locking arms to said post when said pair of support wings is deployed;

when said first and second connectors are released, said second connector releasably connects said pair of support wings to said posts when stowed.

5. The semi-permanent portable satellite antenna system of claim 4 wherein each said first connector is a hinge pin and wherein said second connector is a threaded bolt and threaded knob.

6. The semi-permanent portable satellite antenna system of claim 1 wherein each support wing in said pair of support wings comprises:

an outer frame;

a center bracket affixed to the center of the outer frame and extending from opposing side of the outer frame.

7. The semi-permanent portable satellite antenna system of claim 1 wherein said second end of one of said pair of locking arms releasably connects to said center bracket.

8. The semi-permanent portable satellite antenna system of claim 1 further comprising ballast that rests on said outer frame on both sides of said center bracket.

9. A semi-permanent portable satellite antenna system comprising: a portable satellite antenna and a portable mount, said portable mount holding said portable satellite antenna on a surface when deployed;

said portable satellite antenna comprising:

an antenna mount;

a reflector releasably connected to said antenna mount when deployed;

a plurality of feed arms releasably connected to said reflector when deployed;

a feed releasably connected to said plurality of feed arms when deployed;

said portable mount comprising:

an elongated channel;

a post, one end of said post attached to said elongated channel, said post oriented perpendicular to said elongated channel, the other end of said post releasably connected antenna mount when deployed;

a pair of support braces, one end of each support brace in said pair of support braces attached to said post, the other end of each said support brace attached to said elongated channel, said pair of support braces opposing each other on said elongated channel;

a pair of support wings, said pair of support wings pivotally connected on opposing sides of said elongated channel, said pair of support wings pivoting to said post for said portability and said pair of support wings pivoting to be on said surface when deployed;

a pair of locking arms, a first end of each of said pair of locking arms releasably connected to said post, a second end of each said locking arm releasably connected on one of said pair of support wings, said pair of locking arms opposing each other on said pair of support wings when deployed, said pair of locking arms released from said post and said support wings for said portability.

10. The semi-permanent portable satellite antenna system of claim 9 wherein said antenna mount controls the azimuth and elevation of said reflector when deployed.

11. The semi-permanent portable satellite antenna system of claim 9 wherein said reflector has a rear surface and wherein said antenna mount has a reflector plate further comprising:

a plurality of threaded knobs for releasably connecting the rear of said reflector to said reflector plate.

12. The semi-permanent portable satellite antenna system of claim 9 wherein said reflector has an outer rim and further comprising:

a knob retained on each end of said plurality of reflectors for releasably connected said outer rim of said reflector.

13. The semi-permanent portable satellite antenna system of claim 9 further comprising:

ballast, said ballast resting on said pair of support wings when deployed, said ballast holding said portable mount to said surface.

14. The semi-permanent portable satellite antenna system of claim 9 wherein each support wing in said pair of support wings comprises:

an outer frame;

a center bracket affixed to the center of the outer frame and extending from opposing side of the outer frame.

15. The semi-permanent portable satellite antenna system of claim 14 further comprising ballast that rests on said outer frame on both sides of said center bracket.

16. The semi-permanent portable satellite antenna system of claim 15 wherein said ballast comprises:

a plurality of cement blocks.

* * * * *